United States Patent [19]

Sulzmann

[11] 4,280,228

[45] Jul. 28, 1981

[54] INFANT NURSING GARMENT

[76] Inventor: Donna J. Sulzmann, 1142 Ridge St., Crown Point, Ind. 46307

[21] Appl. No.: 194,056

[22] Filed: Oct. 6, 1980

[51] Int. Cl.[3] ..... A41D 1/20

[52] U.S. Cl. ..... 2/104

[58] Field of Search ..... 2/104, 105, 114; 128/460

[56] References Cited

U.S. PATENT DOCUMENTS

| | | | |
|---|---|---|---|
| 778,014 | 12/1904 | Coyle | 2/104 |
| 1,098,155 | 5/1914 | Knapp | 2/104 |

*Primary Examiner*—Doris L. Troutman

*Attorney, Agent, or Firm*—Walter Leuca

[57] ABSTRACT

A nursing blouse which allows access to the infant to be nursed through openings which are concealed by overlapping portions of the blouse at the sides thereof and which are stitched at new and novel locations of the blouse. The new and novel strips or folds of the blouse at the openings and the stitchings of this invention provide a nursing blouse which does not require connecting means to keep the openings closed when not in use even when the wearer applies stress to the chest part of the blouse due to physical activity and does not require any camoflage design.

18 Claims, 2 Drawing Figures

INFANT NURSING GARMENT

BACKGROUND OF THE INVENTION

1. Field of the Invention

This invention relates generally to garments and more particularly to an infant nursing garment.

2. Description of the Prior Art

The problems of the prior art that this invention is directed are the problems of conspicuousness in that prior art blouses constructed to allow nursing of infants are provided with openings which are kept closed by means of buttons or zippers which due to their location indicate the function of such a blouse even though the design of the blouse may incorporate camouflage or additional strips of material. Camouflaging in general complicates the design of such blouses making them more expensive to manufacture as well as undesirable from a design standpoint if the wearer prefers simple or plain designs. Another disadvantage of the prior art nursing blouse is the tendency to provide the openings in close proximity with the wearer's breast because of the assurance provided by positive closure means such as buttons and zippers. These areas of the blouse are stress areas, and when pressure is applied at these areas during normal wearing and especially when accompanied by movement or physical activity, the openings tend to spread between the points of connection thereby revealing the purpose of the blouse. This is particularly noticeable when buttons are used to secure the openings. Still another disadvantage of the prior art is the problem presented by the buttons, zippers or other fastening means when the garment is washed or laundered.

SUMMARY OF THE INVENTION

Accordingly, my improved garment provides a nursing blouse or dress which allows access to the infant to be nursed through openings which are concealed by overlapping portions of the blouse at the sides thereof and which are stitched at new and novel locations of the blouse. The new and novel strips or folds of the blouse at the openings and the stitchings of this invention provide a nursing blouse which does not require connecting means to keep the openings closed when not in use even when the wearer applies stress to the chest part of the blouse due to physical activity and does not require any camoflage design.

Other objects and advantages will become more apparent after a study of the following detailed description of my invention which is to be read with reference to the accompanying drawings wherein is illustrated a preferred embodiment thereof.

DETAILED DESCRIPTION OF THIS INVENTION

Figure 1:
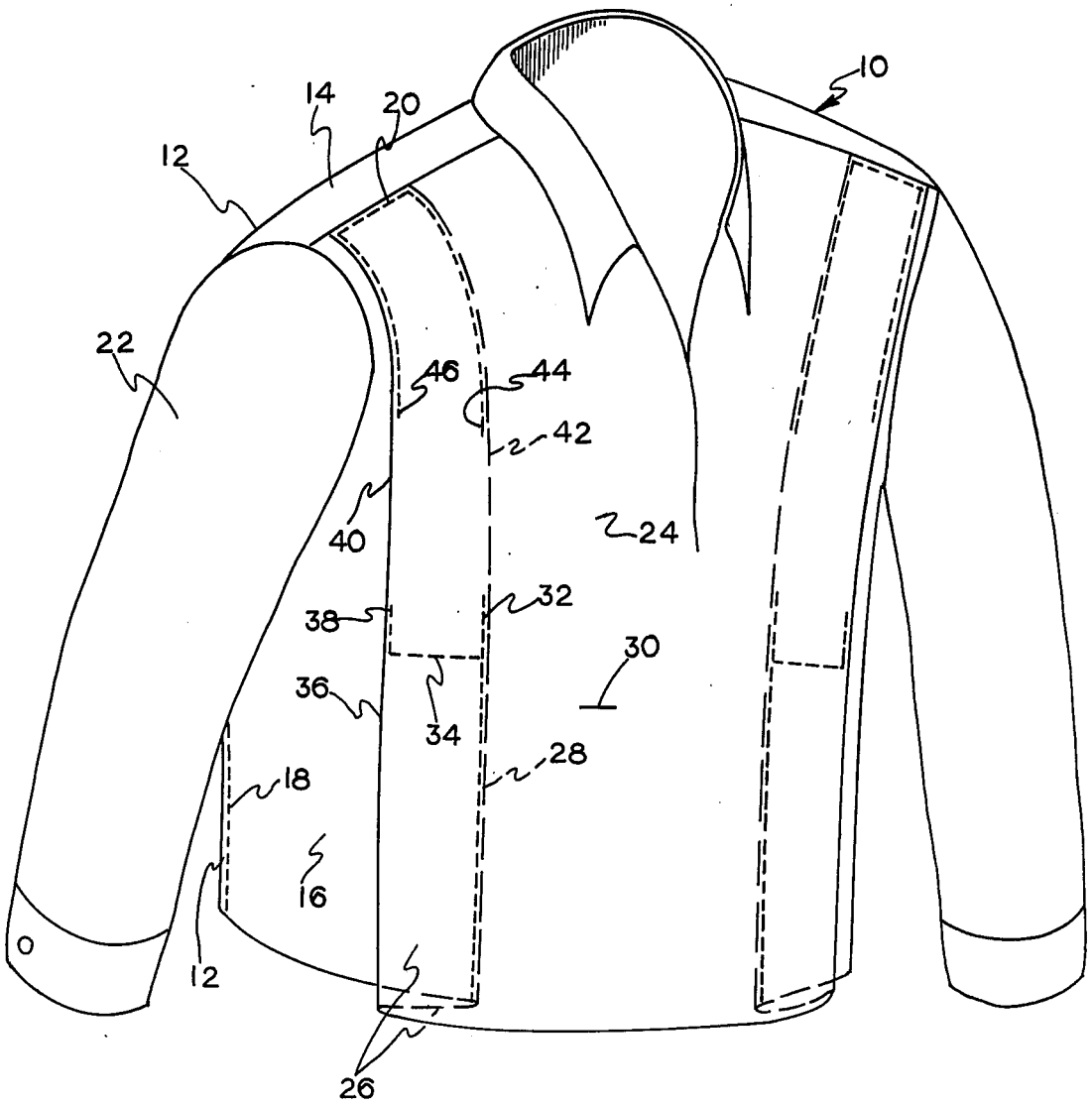
FIG. 1 is a front and side elevation of the blouse of this invention showing the opening of the blouse in closed position and non-nursing use.
Figure 2:
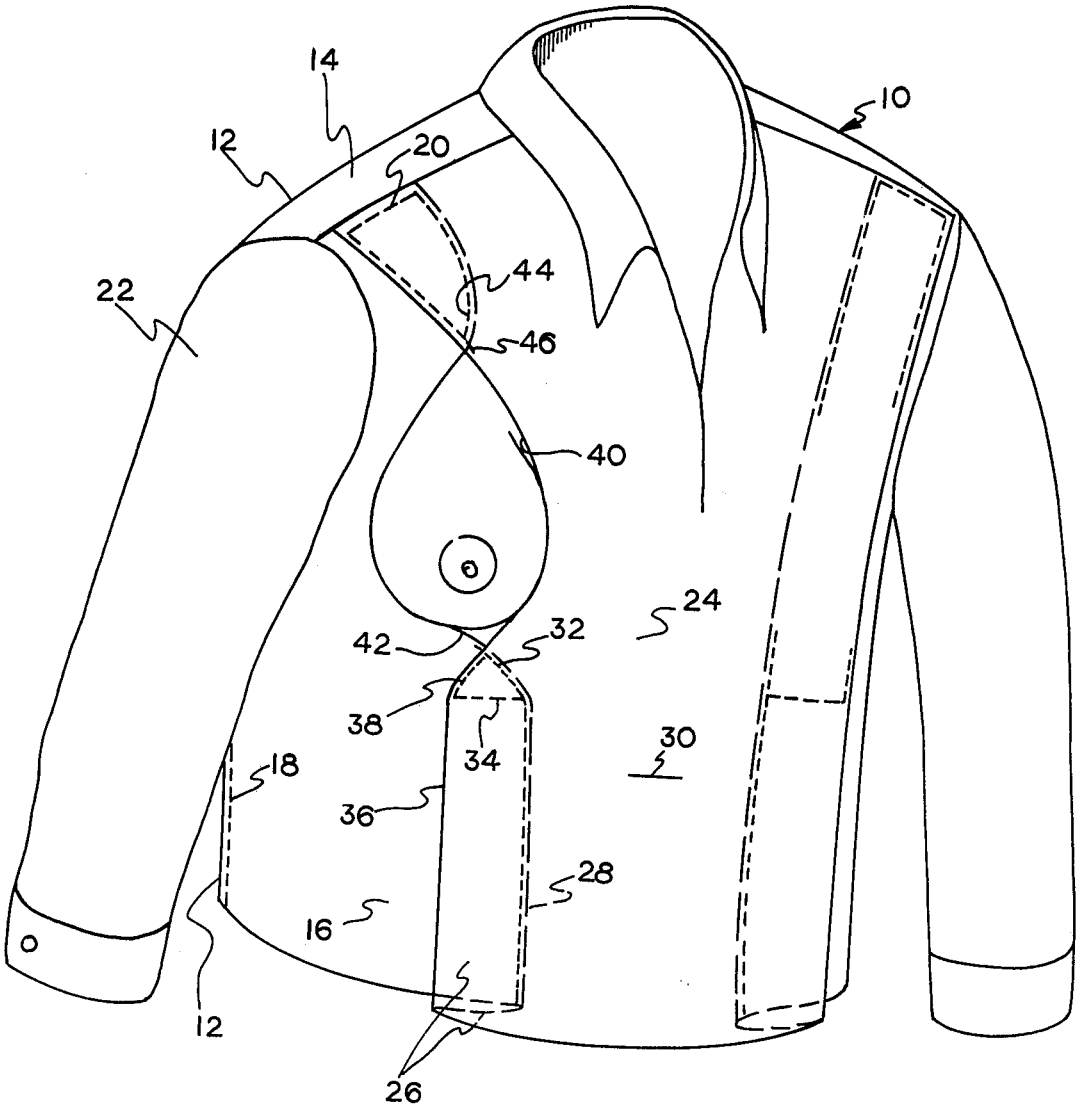
FIG. 2 is a front and side elevation of the blouse of this invention showing the opening of this blouse open and in nursing use.

Referring now more particularly to the drawings wherein is illustrated a preferred embodiment of my nursing blouse, numeral 10 designates generally the blouse of this invention. Hereafter, I will describe the blouse of this invention with reference numerals applied only to one side of the blouse, namely the right side, with the understanding that corresponding parts on the left side of the blouse are identical in structure and function. My blouse comprises a back portion 12 which includes shoulder portion 14 at the top of the back portion. A side portion 16 is sewed to back portion 12 as at seam 18 along its length and to shoulder portion 14 as at seam 20, and around arm 22. Front portion or panel 24 forming the front part of the blouse is folded over as at 26 and sewed to side portion 16 along their respective edges as at 28 to approximately two inches above the natural waistline, which is approximately at 30, as at 32. Front panel 24 is also sewed horizontally across folded side 26 to side portion or panel 16 which extends beneath folded side 26 of front portion or panel 24 as at 34. I further sew folded edge 36 of folded side 26 approximately one and one-half inch above seam 34 at 38 so that seam 38 is slightly shorter than seam 32. I allow an opening at 40 and 42 between the folded side 26 which overlaps the portion of side panel 16 which extends under the folded side 26 of the front panel. Folded side 26 extends over the forward side of side panel 16 to shoulder seam 20. I sew the folded edge 36 of front panel 24 to the forward edge 28 of side panel 16 to approximately the armpit level or slightly below as to 44. The spaced parallel seam 46 is brought down to approximately even with the armpit level or slightly below as to 44. The spaced parallel seam 46 is brought down to approximately even with the armpit line of the blouse. I have found that the inside openings 42 should be approximately one-half inch shorter than the outside opening 40 between folded side 26 and the underlying forward edge of side panel 16. I prefer that the lateral dimension of the folded side 16 of the front panel be approximately four inches and the vertical dimension of opening 40 at folded edge 36 of front panel 24 be approximately seven inches. Though I have described the structure of a breast opening of the blouse of my invention on the right side of the blouse shown in FIGS. 1 and 2, obviously the structure of the opening for the left side of the blouse is the same with the exception, of course, that the corresponding parts are reversed. Also, the principles of my invention may be incorporated into a dress garment. FIG. 2 demonstrates the use of the blouse during the nursing operation. I have found that the novel structure and location as well as the approximate relative dimensions are an important part of this invention in order to permit the openings of the blouse to remain closed and inconspicuous when not in nursing use even though stress is applied to the chest portion of the blouse as a result of physical activity without the use of connectors and without the use of design camouflage.

It is to be understood that though I describe my invention with reference to a blouse, my invention is applicable to a dress or nightgown. Therefore for purposes of this invention the term blouse includes that portion of a dress or gown which corresponds to a blouse.

I claim:

1. A nursing blouse comprising:

overlapping strips extending longitudinally between the arm portion and the breast portion; said strips being connected at their edges to each other forming spaced parallel seams; one of said seams being adjacent the breast portion and the other of said seams being adjacent said arm portion; said strips being connected between said spaced parallel seams forming a lateral seam thereacross; said spaced parallel seams extending upwardly from said lateral seam to the bottom of said breast portion and downwardly from the arm portion to the bottom of said arm portion providing an opening between said overlapping strips between said upwardly and downwardly extending spaced parallel seams; and, said opening between said seams adjacent said breast portion being longitudinally shorter than said opening between said seams adjacent said arm portion.

2. The nursing blouse of claim 1 wherein said opening between said seams adjacent said breast portion is further characterized as being longitudinally shorter approximately one-half inch than said opening between said seams adjacent said arm portion.

3. The nursing blouse of claim 1 wherein said opening between said seams adjacent said breast portion is further characterized as being approximately seven inches in length and said opening between said seams adjacent said arm portion being approximately seven and one-half inches in length.

4. The nursing blouse of claim 1 wherein said strips are further characterized as overlapping approximately four inches.

5. The nursing blouse of claim 1 wherein said lateral seam across said strip is further characterized as being spaced approximately two inches above the waistline of the blouse.

6. The nursing blouse of claim 5 wherein said seam extending upwardly from said lateral seam adjacent the breast portion is further characterized as extending upwardly from said lateral seam approximately two inches.

7. A nursing blouse comprising:

a front portion laterally overlapping a side portion; said laterally overlapping portion forming longitudinally extending strips between the arm portion and the breast portion; said strips being connected at their edges to each other forming spaced parallel seams; one of said seams being adjacent the breast portion and the other of said seams being adjacent said arm portion; said strips being connected below the breast portion between said spaced parallel seams; said parallel seams extending upwardly from said connection to the bottom of said breast portion and downwardly from the arm portion to the bottom of said arm portion providing an opening between said overlapping strips between said upwardly and downwardly extending spaced parallel seams; and, said opening between said seams adjacent said breast portion being longitudinally shorter than said opening between said seams adjacent said arm portion.

8. The nursing blouse of claim 7 wherein said connection of said strips between spaced parallel seams is further characterized as forming a lateral seam thereacross.

9. The nursing blouse of claim 7 wherein said opening between said seams adjacent said breast portion is further characterized as being longitudinally shorter approximately one-half inch than said opening between said seams adjacent said arm portion.

10. The nursing blouse of claim 7 wherein said opening between said seams adjacent said breast portion is further characterized as being approximately seven inches in length and said opening between said seams adjacent said arm portion as being approximately seven and one-half inches in length.

11. The nursing blouse of claim 7 wherein said strips are further characterized as overlapping approximately four inches.

12. A nursing blouse comprising front, back, side and arm portions for draping a female torso, wherein the improvement comprises:

overlapping strips extending longitudinally between the arm portion and the breast portion; said strips being connected at their edges to each other forming spaced parallel seams; one of said seams being adjacent the breast portion and the other of said seams being adjacent said arm portion; said strips being connected between said spaced parallel seams; said spaced parallel seams extending upwardly from said connection to the bottom of said breast portion and downwardly from the arm portion to the bottom of said arm portion providing an opening between said overlapping strips between said upwardly and downwardly extending spaced parallel seams; and, said opening between said seams adjacent said breast portion being longitudinally shorter than said opening between said seams adjacent said arm portion.

13. The nursing blouse of claim 12 wherein said connection of said strips between said spaced parallel seams is further characterized as forming a lateral seam thereacross below the breast portion.

14. The nursing blouse of claim 12 wherein said opening between said seams adjacent said breast portion is further characterized as being longitudinally shorter approximately one-half inch than said opening between said seams adjacent said arm portion.

15. The nursing blouse of claim 12 wherein said opening between said seams adjacent said breast portion is further characterized as being approximately seven inches in length and said opening between said seams adjacent said arm portions being approximately seven and one-half inches in length.

16. The nursing blouse of claim 12 wherein said strips are further characterized as overlapping approximately four inches.

17. The nursing blouse of claim 12 wherein said lateral seam across said strip is further characterized as being approximately two inches above the waistline of the blouse.

18. The nursing blouse of claim 17 wherein said seam extending upwardly from said lateral seam adjacent the breast portion is further characterized as extending upwardly from said lateral seam approximately two and one-half inches.

* * * * *